US006360933B1

(12) United States Patent
Richardot et al.

(10) Patent No.: US 6,360,933 B1
(45) Date of Patent: Mar. 26, 2002

(54) STAPLER DESIGNED TO RECEIVE DIFFERENT SIZE STAPLES

(75) Inventors: Francis Richardot, Le val d'Ajol; Alain Dran, Le Syndicat, both of (FR)

(73) Assignee: Sofragraf Industries, Saint-Ame (FR)

( * ) Notice: Subject to any disclaimer, the term of this patent is extended or adjusted under 35 U.S.C. 154(b) by 01 day.

(21) Appl. No.: 09/175,998

(22) Filed: Oct. 21, 1998

(30) Foreign Application Priority Data

Oct. 24, 1997 (FR) ..... 97 13378

(51) Int. Cl.[7] ..... B25C 5/16
(52) U.S. Cl. ..... 227/109; 227/119; 227/120
(58) Field of Search ..... 227/109, 119, 227/120, 134, 132

(56) References Cited

U.S. PATENT DOCUMENTS

| | | | | |
|---|---|---|---|---|
| 1,945,377 A | | 1/1934 | Posnack | |
| 2,716,749 A | * | 9/1955 | Timmerbeil | 227/109 |
| 3,958,738 A | | 5/1976 | Tremblay | |
| 4,552,296 A | * | 11/1985 | Sheng | 227/119 |
| 4,556,161 A | * | 12/1985 | Oide | 227/120 |
| 4,667,865 A | * | 5/1987 | Judge | 227/109 |
| 5,695,108 A | * | 12/1997 | Lee | 227/109 |
| 5,794,832 A | * | 8/1998 | Chen | 227/119 |

FOREIGN PATENT DOCUMENTS

| | | |
|---|---|---|
| DE | 3500279 | 7/1986 |
| DE | 3817862 | 2/1989 |
| FR | 2568813 | 2/1986 |

* cited by examiner

*Primary Examiner*—Scott A. Smith
(74) *Attorney, Agent, or Firm*—Stevens, Davis, Miller & Mosher, L.L.P.

(57) ABSTRACT

A stapler includes an elongate loader which receives sticks of staples with a back width in a particular range of widths and a slider attached to a rail and mobile between a first position in which it allows access to the loader and a second position in which the rail passes between the legs of a stick of staples installed in the loader to guide them towards a driver. The rail is positioned on the cover and has transverse dimensions such that it can pass freely between the legs of the staples. Cams are provided to move the rail laterally when the slider moves from its first position to its second position.

5 Claims, 1 Drawing Sheet

STAPLER DESIGNED TO RECEIVE DIFFERENT SIZE STAPLES

BACKGROUND OF THE INVENTION

1. Field of the Invention

The present invention concerns a stapler comprising an elongate loader adapted to receive sticks of staples with a back width in a particular range of widths and a loader cover attached to a rail and mobile between a first position in which it allows access to the loader and a second position in which the rail passes between the legs of a stick of staples installed in the loader to guide them towards a driver that can be operated to separate the staple at the head of the stick and implant it in a final support.

2. Description of the Prior Art

Staplers of the above kind designed to receive different size staples are known in themselves, for example the ROCAFIX MS 10 stapler supplied by the French company Sofragraf Industries. The instructions for installing a straight stick of staples in the loader of the stapler specify that said stick must bear against a particular lateral flank of the loader before the cover is moved from its first position to its second position in which the rail passes between the legs of the staples in the stick. If a stick of staples with a "back" width (leg spacing) less than the maximal width accepted by the stapler bears on the other flank of the loader and the cover carrying the staple guide rail is then moved towards its second position in which it closes the loader, the rail can butt up against the stick of staples in the loader instead of passing freely between the legs of the staples. It is then impossible to close the loader and use the stapler.

FR-A-2 568 813 describes another stapler designed to accept different size staples. It includes an elongate magazine (loader) comprising two U-sections joined by a central support member serving as a rail for the staples. The two sections have different widths. One is narrow to closely surround one branch (leg) of a staple. The other is wider so that it can accommodate the other leg of the staple regardless of its back width provided that this width is within a predetermined range of widths. Installing a stick of staples on a rail of the above kind calls for some care because a part of the stick must be inserted into a narrow U-section the width of which is only slightly greater than the thickness of the wire from which the thickest staples that the stapler can receive are made.

An aim of the present invention is to provide a stapler of the type described in the preamble to this description that does not have any of the disadvantages mentioned above and which therefore enables the fitting without special precautions of a stack or stick of staples whose back width can vary within a predetermined range.

SUMMARY OF THE INVENTION

The above aim of the invention, and others that will become apparent after reading the following description, are achieved with a stapler of the type described in the preamble to this description that is remarkable in that the rail is positioned on the loader cover and has transverse dimensions such that when it is moved to its second position it can pass freely between the legs of the staples of a stick of staples having a back width at least equal to a lower threshold of the range of predetermined widths, whether the staples bear against one or the other of two parallel lateral flanks of the loader and cam means are provided to move the rail laterally when the cover moves from its first position to its second position.

As will become apparent later, this lateral movement assures close guidance of the stick of staples in the loader regardless of the back width of the staples in the stick provided that this width is within the predetermined range of widths.

Other features and advantages of the present invention will become apparent on reading the following description and examining the accompanying drawings.

DETAILED DESCRIPTION OF THE PREFERRED EMBODIMENT

Figure 1:
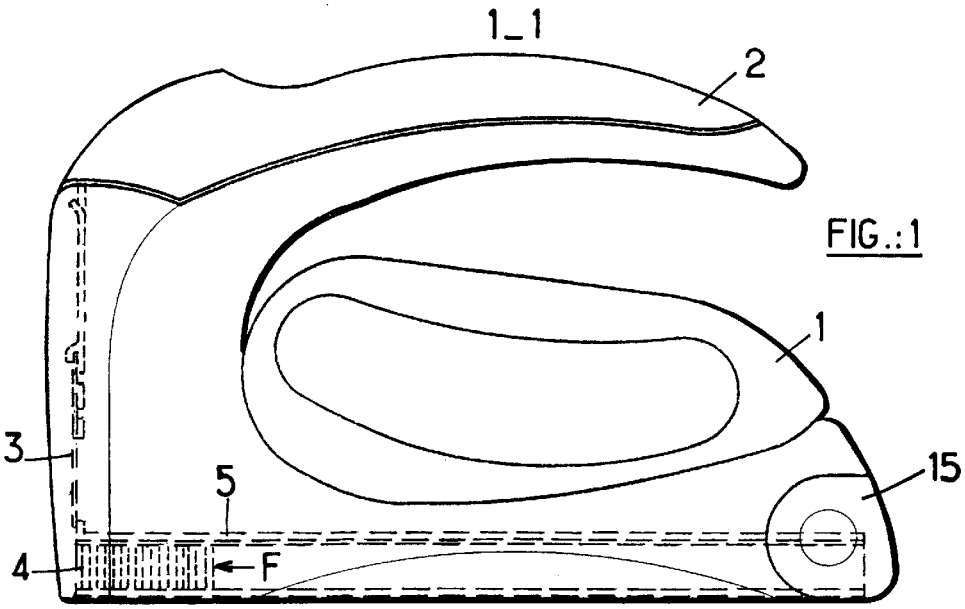
FIG. 1 is an elevation view of an improved stapler in accordance with the present invention.

FIG. 1 of the accompanying drawing shows that the stapler in accordance with the invention essentially comprises a handle 1 and a lever 2 that are held in the hand to arm and trigger, in the conventional way, a driver 3 adapted to separate the staple at the head of a stick or stack of staples 4 installed in a loader 5 of the stapler. A spring member (not shown) pushes the stick of staples in the direction of the arrow F against an abutment defining a position of the staple at the head of the stick in line with the driver 3. All these arrangements are well known in themselves and do not require a more detailed description.

Note that the handle 1, the lever 2 and, generally, the whole of the exterior of the stapler have rounded shapes that are purely ornamental.

Figure 2:
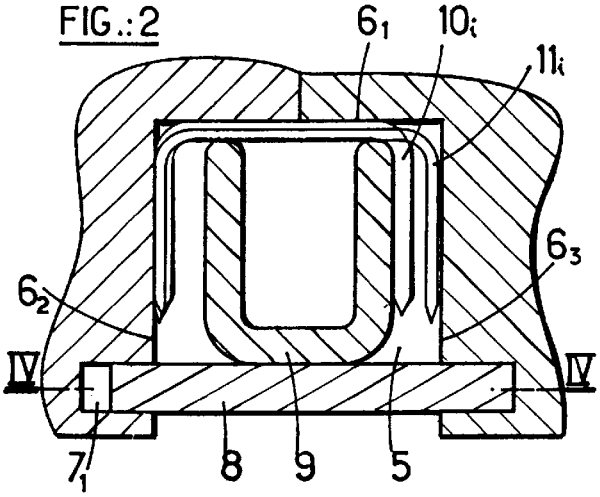
FIGS. 2 and 3 are diagrammatic views of the loader of the stapler in accordance with the invention in cross-section taken along the section lines II—II and III—III in FIGS. 4 and 5, respectively.
Figure 3:
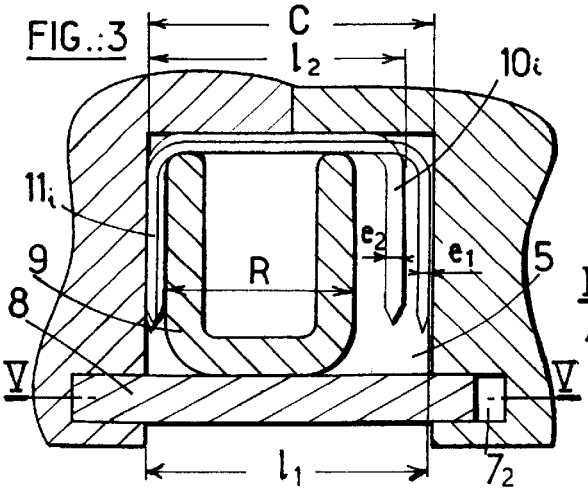

FIGS. 2 through 5 of the accompanying drawing are diagrammatic representations of the loader 5 from the stapler in accordance with the invention. As is apparent in FIGS. 2 and 3, it is in the form of an elongate channel of rectangular cross-section (for example) closed by a cover 8. In the embodiment shown by way of purely illustrative and non-limiting example the cover 8 takes the form of a slider. The channel has a bottom $\mathbf{6}_1$ and lateral flanks $\mathbf{6}_2$, $\mathbf{6}_3$. The latter feature two grooves $\mathbf{7}_1$ and $\mathbf{7}_2$ in which slides the slider 8 to which a U-section rail 9 is fixed, parallel to the greatest dimension of the slider. As shown in FIGS. 2 and 3, the staples such as the staple $\mathbf{10}_i$ of a stick 4 of n staples (i from 1 through n) are mounted to straddle the rail 8 in the loader.

The stapler in accordance with the invention is adapted to receive staples with different back widths and possibly different thicknesses. FIGS. 2 and 3 show staples $\mathbf{10}_i$ and $\mathbf{11}_i$ with respective widths $l_1$ and $l_2$ and respective thicknesses $e_1$ and $e_2$, these staples having the minimum and maximum widths of a predetermined range of widths that the stapler can accept. To give an illustrative and non-limiting example, the stapler can accept staples with widths varying in the range 10.57 mm to 11.53 mm, i.e. a variation of almost 10% in the width of the staples.

FIGS. 2 and 3 show that the width of the slider 8 is less than the distance between the bottoms of the grooves $\mathbf{7}_1$ and $\mathbf{7}_2$ in which the slider slides. This enables the slider and the rail 9 that it carries to move from the position shown in FIG. 2 to that shown in FIG. 3, and vice versa, for the purpose explained hereinabove.

Whatever the width and the thickness of the staples placed in the loader 5, the head staple must be perfectly located under the driver 3 in a plane perpendicular to the axis of the rail. To achieve this at least one side of the stick of staples 4, for example that facing the flank $\mathbf{6}_2$ of the loader 5, must be closely guided between the rail and that flank, as shown in FIG. 3.

Figure 4:
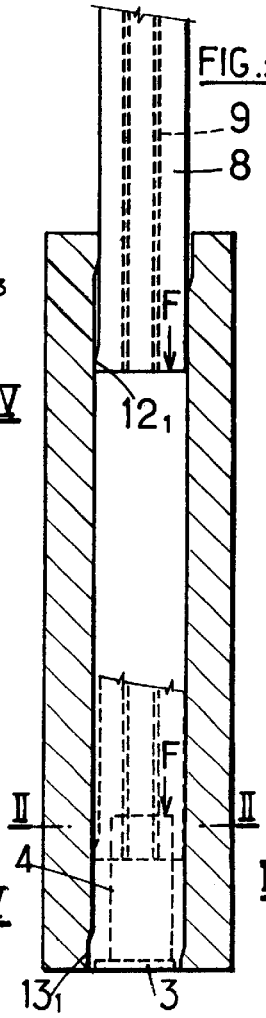
FIGS. 4 and 5 are diagrammatic plan views of said slider on the section lines IV—IV and V—V in FIGS. 2 and 3, respectively.
Figure 5:
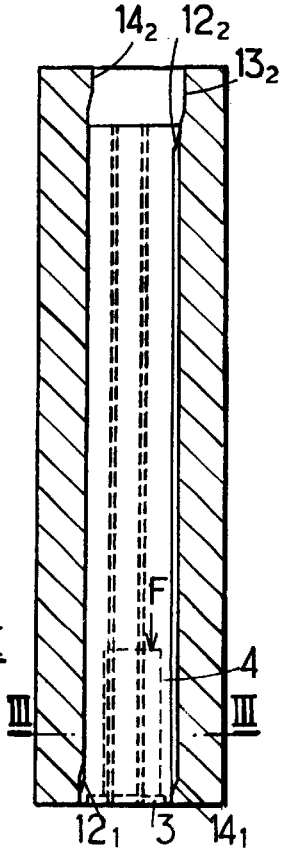

With the loader open in the position shown in full line in FIG. 4 and a stick of staples 4 placed on the bottom of the loader, it must be possible to close the loader by pushing the slider 8 from the position shown in FIG. 4 to the position shown in FIG. 5. One aim of the present invention is to make this operation possible without requiring any particular precaution of the operator, regardless of the width and/or the position of the stick of staples placed in the loader.

This aim of the invention is achieved by moving the rail 9 from a substantially central position in the loader shown in FIG. 2 to the lateral position shown in FIG. 3.

The central position shown in FIG. 2 enables the rail to pass between the legs of the staples, regardless of their width (between $l_1$ and $l_2$) and regardless of which flank $\mathbf{6}_2$ or $\mathbf{6}_3$ of the loader the stick is pressed against.

The lateral position shown in FIG. 3 defines a narrow passage between the rail 9 and the flank $\mathbf{6}_2$ of the loader, for example, the width of which is slightly greater than the thickness of the thickest acceptable staple. Accordingly, the axis of the stick of staples remains substantially parallel to that of the rail which enables the head staple to be offered up exactly in line with the driver 3 which consists of a blade mobile in a plane perpendicular to the axis of the rail.

FIG. 4 shows in dashed line the position of the slider 8 and of the rail 9 after the rail has begun to engage between the legs of the staples of a stick of staples 4 in which the head staple is pressed against the abutment and thus positioned under the driver 3 by the spring means mentioned above, symbolized by the arrow F, mounted on the rail 9.

It can be shown that for the rail 9 to be able to move between the legs of the staples without interference when it is pushed from the FIG. 4 position to the FIG. 5 position, the width R of the rail must be such that:

$$R<2l_2+2e_2-C \tag{1}$$

C being the width of the loader and $l_2$ and $e_2$ the back width and the thickness of the narrowest permissible staple, respectively.

For the thinnest staple to be correctly guided in the space between the rail 9 and the flank $\mathbf{6}_2$ of the loader, the width of which, ignoring a clearance j, is equal to the thickness of the thickest staple, the thickness $e_1$ and $e_2$ are constrained, in accordance with the invention, to satisfy the following relations:

$$\left.\begin{aligned} e_2 &> \frac{1}{2}(e_1+j) \text{ if } e_1>e_2 \\ e_1 &> \frac{1}{2}(e_2+j) \text{ if } e_2>e_1 \end{aligned}\right\} \tag{2}$$

Experiments have shown that when the slider 8 closes the loader 5, to assure good guidance of the widest stick of staples 4 the width R of the rail 9 must be such that:

$$R>\frac{3}{4}l_1 \tag{3}$$

Also, the widest stick must be able to enter the loader, so that:

$$C>l_1+2e_1 \tag{4}$$

The following equation can be derived from the above equation (1), (3) and (4):

$$l_2>\frac{7}{8}l_1+e_1-e_2 \tag{5}$$

The above equations are used to calculate the lateral offset of the slider 8 required to move the rail from the position shown in FIG. 2 to the position shown in FIG. 3. In practise, this offset is obtained by cam means at the ends of the grooves $\mathbf{7}_1$, $\mathbf{7}_2$ and of the slider 8, as shown in FIGS. 4 and 5. The cam means comprise cams $\mathbf{12}_1$, $\mathbf{12}_2$ formed at the two ends of the slider 8, on two opposite edges thereof, these cams projecting from these edges but having the same thickness, equal to the calculated offset. The cams $\mathbf{12}_1$, $\mathbf{12}_2$ cooperate with respective counter-cams $\mathbf{13}_1$, $\mathbf{13}_2$ formed at the bottom of the respective grooves $\mathbf{7}_1$, $\mathbf{7}_2$ at two opposite ends thereof.

At their other opposite ends, the grooves include cams $\mathbf{14}_1$, $\mathbf{14}_2$ the same height as the aforementioned cams and counter-cams that cooperate with the facing narrow edges $\mathbf{15}_1$, $\mathbf{15}_2$ of the slider 8 to maintain the axes of the slider 8 and of the loader 5 parallel when the loader is closed by the slider. This parallel relationship assures correct positioning of the staples under the driver 3 in a plane perpendicular to its axes.

To load the stapler with a stick of staples as defined by the above equations, the loader is opened by sliding the slider 8 to the position shown in FIG. 4.

The stick is placed in the loader so that the backs of the staples rest against the back of the loader. The loader is then closed simply by pushing the slider 8 to the position shown in FIG. 5, in which position it is held by a catch (not shown). An operating button 15 (see FIG. 1) releases the catch to open the loader.

During the movement that closes the loader the rail 8 engages securely between the legs of the staples, regardless of the transverse position of the stick of staples, and there is then no risk of the rail jamming against the stick of staples. At the end of the movement of the slider the cams and counter-cams mentioned above automatically bring about the lateral offset of the rail required for close guidance of the stick of staples.

It is now apparent that the present invention achieves the stated aim, namely the fitting of staples with various widths into the loader of a stapler without special precautions and in a way that assures good guidance of all sticks of staples, from the narrowest to the widest, provided that the dimensions of the staples are related by the above equations (2) and (5).

Of course, the invention is not limited to the embodiment described and shown which has been given by way of example only. Thus the present invention can easily be adapted to a loader in which the rail is hinged rather than slides.

We claim:

1. A stapler comprising an elongate loader adapted to receive sticks of staples with a back width in a particular range of widths, a loader cover attached to a rail and mobile between a first position in which said cover it allows access to said loader and a second position in which said rail passes between legs of a stick of staples installed in said loader to guide said staples towards a driver that is operable to separate a staple at the head of said stick and implant said staple in a final support, wherein said rail is positioned on said cover and has transverse dimensions such that said rail can pass freely between said legs of said staples of a stick of staples having a back width at least equal to a lower threshold of said range of predetermined widths, wherein said staples bear against either of two parallel lateral flanks of said loader and cam means are provided to move said rail laterally when said cover moves from its first position to its second position.

2. The stapler claimed in claim 1 wherein once said cover is in said second position a part of said stick of staples which is located between one face of said rail and a facing flank of said loader is closely guided between said face and said flank.

3. The stapler claimed in claim 1 wherein said cover takes the form of a slider mobile in facing grooves formed in said flanks of said loader and said cam means are divided between corresponding ends of said grooves and said slider to move said slider laterally when said slider reaches a second position in which said slider closes said loader.

4. The stapler claimed in claim 1 wherein a maximal back width $l_1$ and a minimal back width $l_2$ of said staples received in said loader are related to thicknesses ($e_1$, $e_2$) of wire from which they are made by the equation:

$$l_2 > \frac{7}{8} l_1 + e_1 - e_2$$

5. The stapler claimed in claim 4 wherein said thicknesses $e_1$ and $e_2$ are related by the equation:

$$e_2 > \frac{1}{2}(e_1 + j) \text{ if } e_1 > e_2$$

or $$e_1 > \frac{1}{2}(e_2 + j) \text{ if } e_2 > e_1$$

where j is a functional clearance.

* * * * *